US008373521B2

(12) United States Patent
Sakagami et al.

(10) Patent No.: US 8,373,521 B2
(45) Date of Patent: Feb. 12, 2013

(54) PLANAR STRUCTURE MICROWAVE SIGNAL MULTI-DISTRIBUTOR

(75) Inventors: Iwata Sakagami, Toyama (JP); Tuya Wuren, Toyama (JP)

(73) Assignee: National University Corporation University of Toyama, Toyama (JP)

( * ) Notice: Subject to any disclaimer, the term of this patent is extended or adjusted under 35 U.S.C. 154(b) by 695 days.

(21) Appl. No.: 12/515,351

(22) PCT Filed: Nov. 19, 2007

(86) PCT No.: PCT/JP2007/072382

§ 371 (c)(1),
(2), (4) Date: Jul. 16, 2009

(87) PCT Pub. No.: WO2008/062754

PCT Pub. Date: May 29, 2008

(65) Prior Publication Data

US 2010/0079219 A1 Apr. 1, 2010

(30) Foreign Application Priority Data

Nov. 20, 2006 (JP) ..... P2006-313003

(51) Int. Cl.
*H01P 5/12* (2006.01)

(52) U.S. Cl. ..... 333/125; 333/100; 333/26; 333/137

(58) Field of Classification Search ..... 333/100, 333/26, 124, 125, 136, 137
See application file for complete search history.

(56) References Cited

U.S. PATENT DOCUMENTS 4,356,462 A * 10/1982 Bowman ..... 333/128
4,947,143 A 8/1990 Abouzahra et al.
5,796,317 A * 8/1998 Bohlman et al. ..... 333/127

FOREIGN PATENT DOCUMENTS

JP 58-161502 A 9/1983
JP 04-239802 A 8/1992

(Continued)

OTHER PUBLICATIONS

"N-Way Wilkinson Splitters", http://www.microwaves101.com/encyclopedia/wilkinson_nway.cfm, updated Oct. 31, 2006.

(Continued)

*Primary Examiner* — Robert Pascal
*Assistant Examiner* — Kimberly Glenn
(74) *Attorney, Agent, or Firm* — Sughrue Mion, PLLC

(57) ABSTRACT

In a conventional Bagley polygon power divider of a planar configuration, a length of transmission lines from an input port to output ports adjacent thereto on both sides is determined to be a quarter wavelength and a geometry thereof is an odd regular polygon with each side being a length equal to half of a wavelength at a designed frequency, which is large in size. Since the output ports are located at vertices of the regular polygon, inconvenience can be caused, e.g., in arrangement of the output ports.

The present invention is directed to a design wherein only a characteristic impedance of a transmission line is designated for achieving matching and wherein a length of the line is allowed to be arbitrarily selected. This permits the line length between adjacent output ports to be appropriately adjusted to a short one according to a design object, and also enables fabrication of a power divider in which output ports are aligned in a line.

4 Claims, 9 Drawing Sheets

FOREIGN PATENT DOCUMENTS

| | | | |
|---|---|---|---|
| JP | 9-289405 | A | 11/1997 |
| JP | 10-308610 | A | 11/1998 |

OTHER PUBLICATIONS

M.Kishihara et al.,"Design of Broadband Microstrip-Type Multi-Way Power Dividers", Asia-Pacific Microwave Conference Proc., Nov. 2003, pp. 1688-1691.

Mitsuyoshi Kishihara et al., "Parallel Processing of Powell's Optimization Algorithm and its Application to Design of Multi-Way Power Dividers", Asia Pacific Microwave Conference, Proc., 2005.

Eric L. Holzman, "An Eigenvalue Equation Analysis of a Symmetrical Coax Line to N-Way Waveguide Power Divider", IEEE Transactions on Microwave Theory and Techniques, Jul. 1994, pp. 1162-1166, vol. 42, No. 7.

Robert M. Barrett, "Microwave Printed Circuits—A Historical Survey", IEEE Trans. on MTT, Mar. 1955, pp. 1-9, vol. 3, Issue 2.

Donald J. Sommers, "Slot Array Employing Photoetched Tri-Plate Transmission Lines", IEEE Trans. on MTT, Mar. 1955. p. 157-162, vol. 3, Issue 2.

"http://www.dc2light.pwp.blueyonder.co.uk/Webpage/Hybridcouplers.htm#bagley", dated Nov. 2, 2006.

"Hybrid Couplers", http://www.dc2light.pwp.blueyonder.co.uk/Webpage/Hybridcouplers.htm, dated Nov. 2, 2006.

Office Action issued by the Japanese Patent Office in Japanese Application No. 2008-545394 dated Jul. 17, 2012.

"Microwave Engineering—Basic Principles-" Masamitsu Nakajima, Morikita Publishing Co., Ltd, especially equation (3.10), Apr. 15, 1975, p. 84-p. 85, 328.

* cited by examiner (a) S11 & S12

(b) S13

(a) S11 & S12

(b) S13 & S14

PLANAR STRUCTURE MICROWAVE SIGNAL MULTI-DISTRIBUTOR

TECHNICAL FIELD

The present invention relates to microwave multi-way dividers and, more particularly, to an odd-way power divider having the same symmetrical structure as the Bagley Polygon Power Divider.

BACKGROUND ART

The Wilkinson power splitter is well known as a circuit to split a microwave or millimeter-wave signal into N ways (Non-patent Document 1). This circuit can also be used as a signal combiner and is matched with respect to any input or output port. Furthermore, isolation is achieved among N-way output ports. However, the circuit structure with N being three or more is stereoscopic and thus not suitable for implementation of applications to planar configurations and integrated circuits, but there are some known innovations (Patent Document 1).

In contrast to it, there are power dividers in use with only a function to divide an input signal into multi-ways. In this case, the power dividers are also required to produce no reflection component with entry of an input signal. Multi-way divider circuits with a transformer (Non-patent Documents 2 and 3) and Bagley polygon power dividers (Non-patent Document 4) are circuits with such function in a planar configuration. Another known power divider is a circuit to feed power with a coaxial cable from underside of a substrate and to radially divide a signal into multi-ways on a surface of a substrate (Non-patent Document 5).

Non-patent Document 1: http://www.microwaves101.com/encyclopedia/wilkinson_nway.cfm Non-patent Document 2: M. Kishihara, K. Yamane and I. Ohta, "Design of broadband microstrip-type multi-way power dividers," Asia-Pacific Microwave Conference, Proc., vol. 3, pp. 1688-1691, November 2003.

Non-patent Document 3: M. Kishihara, K. Yamane and I. Ohta, "DParallel processing of powell's optimization algorithm and its application to design of multi-way power dividers," Asia-Pacific Microwave Conference, Proc., 2005.

Non-patent Document 4: http://www.dc2light.pwp.blueyonder.co.uk/Webpage/Hybrid-couplers.ht m#bagley Non-patent Document 5: E. L. Holzman, "An eiginvalue equation analysis of a symmetrical coax line to N-way waveguide power divider," IEEE Trans. on MTT, Vol. 42, No 7, July 1994.

Patent Document 1: Japanese Patent Application Laid-open No. 9-289405

DISCLOSURE OF THE INVENTION

Problem to be Solved by the Invention

The conventional Bagley polygon power dividers can divide an input signal into (2n+1) signals (where n is an integer) in the planar configuration, but it is necessary that a length of each transmission line between adjacent output ports should be a half wavelength and that a length of transmission lines from an input port to output ports adjacent thereto on both sides should be a quarter wavelength. Specific geometries are odd regular polygons each side of which has a length equal to half of a wavelength at a designed frequency, and they are large in size. Furthermore, since output ports are arranged at vertices of the regular polygon, inconvenience can be caused, for example, in terms of arrangement of the output ports (FIG. 1).

Means for Solving the Problem

The present invention is directed to a design that designates only a characteristic impedance of a transmission line in order to achieve matching and that permits a line length to be arbitrarily selected. This permits a line length between adjacent output ports to be appropriately adjusted to a short one according to a design object, and enables fabrication of a power divider in which output ports are aligned in a line.

The present invention will be described below in detail.

The present invention provides an odd-way power divider wherein only a characteristic impedance of a transmission line between output ports is designated and wherein a length of the transmission line is allowed to be arbitrarily selected. Furthermore, the odd-way power divider is characterized in that a transmission line from an input port to an output port has a line length of a quarter wavelength in order to achieve matching at the input port and in that a geometry of the power divider is symmetrical when viewed from the input port.

Effect of the Invention

While in the Bagley polygon power dividers the length of each side of the regular polygon without connection to the input port is the half wavelength, the present invention provides the power divider wherein the length is allowed to be arbitrary and, as a consequence, achieves great reduction in size. Furthermore, since the present invention allows the distance between output ports to be freely set, degrees of freedom for design are increased, e.g., in arrangement of output ports.

BEST MODE FOR CARRYING OUT THE INVENTION

Figure 2:
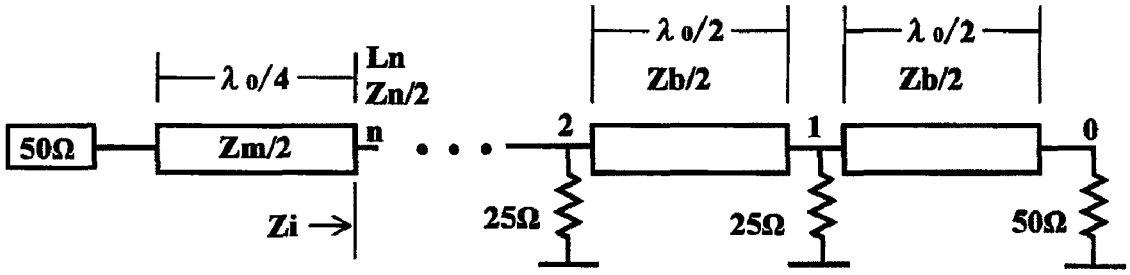
FIG. 2 is an equivalent circuit of a conventional (2n+1)-way Bagley polygon power divider.

Supposing the characteristic impedance of transmission lines connected to all ports is 50Ω, an equivalent circuit from an input port of a conventional (2n+1)-way Bagley polygon power divider is as shown in FIG. 2, in view of symmetry.

In FIG. 2, Zb represents the characteristic impedance of half-wavelength transmission lines and Zm the characteristic impedance of a quarter-wavelength transmission line. Zi represents the input impedance where the equivalent circuit is viewed from the right end of the quarter-wavelength transmission line. This Zi is formulated as in Expression (1) below.

[Mathematical Expression 1]

$$Zi = \frac{50}{2n+1} \tag{1}$$

In consideration of matching at the input port, Zm is given by Expression (2).

[Mathematical Expression 2]

$$Zm = \frac{2*50}{\sqrt{2n+1}} \tag{2}$$

The value of Zb can be arbitrarily selected without effect on the matching of the Bagley polygon power divider, and then Zb=Zm is assumed herein.

Figure 3:
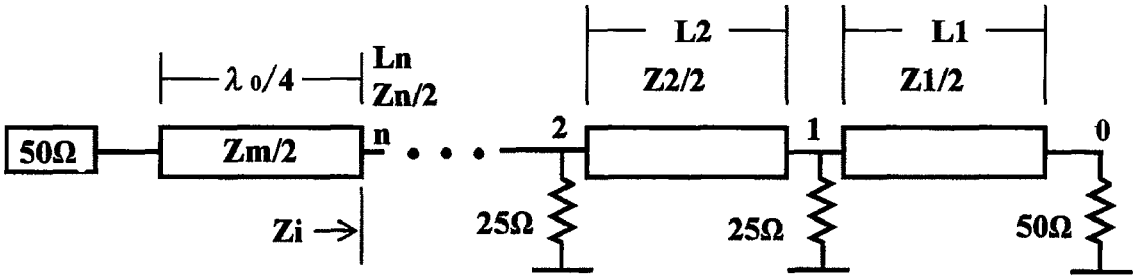
FIG. 3 is an equivalent circuit of a (2n+1)-way Bagley polygon power divider according to the present invention.

An equivalent circuit from the input port of the (2n+1)-way Bagley polygon power divider according to the present invention is as shown in FIG. 3.

In FIG. 3, Zj (j=1, 2, . . . , n) represents the characteristic impedance of the jth transmission line from the right in the drawing and Lj (j=1, 2, . . . , n) the length of the transmission line. Positions where resistors of shunts are arranged are numbered as 0, 1, 2, . . . , n from the right.

From the equivalent circuit of FIG. 3, when Z1/2=50, matching with a load is achieved at position 0 independent of the line length L1; when Z2/2=50/3, matching with a load is achieved at position 1 independent of the line length L2. Concerning matching with a load at position (n−1), the characteristic impedance of the nth transmission line is defined by Expression (3).

[Mathematical Expression 3]

$$Zn/2 = \frac{50}{2n-1} \tag{3}$$

A load at position n is given by Expression (4).

[Mathematical Expression 4]

$$Zi = \frac{50}{2n+1} \tag{4}$$

The matching between 50Ω at the input port and the load of Expression (4) is expressed by Expression (5), with respect to Zm.

[Mathematical Expression 5]

$$Zm = \frac{2*50}{\sqrt{2n+1}} \tag{5}$$

Expressions (3) and (4) above indicate that, for each of the plurality of output ports on the equivalent circuit of FIG. 3, the characteristic impedance of a transmission line connected to one output port from the direction of the input port is equal to a combined impedance of those at one or more output ports at positions away from the input port with respect to the transmission line, including the one output port of interest. The left-hand side of Expression (3) is the characteristic impedance of the nth (n=1, 2, . . . , n) transmission line and the right-hand side is the combined impedance of those at one or more output ports. Expression (4) is the combined impedance of those at all the output ports at position n in FIG. 3.

For example, the characteristic impedance Z1/2 of the transmission line with the length L1 connected to the output port corresponding to position 0 in FIG. 3 (which will be referred to hereinafter as "output port 0") from the direction of the input port (the left in FIG. 3) is equal to the load impedance 50 (Ω) at output port 0. The characteristic impedance Z2/2 of the transmission line with the length L2 connected to the output port corresponding to position 1 in FIG. 3 (which will be referred to hereinafter as "output port 1") from the direction of the input port is equal to the combined impedance 50/3 (Ω) of the load impedance at output port 0 and the load impedance at output port 1. Since output port 1 is actually two output ports, the combined impedance 50/3 (Ω) is a value resulting from combining of load impedances at three output ports. Hereinafter, the same relation also holds for the output port corresponding to position 2 and the output port corresponding to position (n−1).

The load of the transmission line with the length $\lambda_0/4$ connected to the output port corresponding to position n in FIG. 3 (which will be referred to hereinafter as "output port n") from the direction of the input port is Zi and is equal to the combined impedance 50/(2n+1) (Ω) of those at output ports 0-n. The characteristic impedance Zm/2 of this $\lambda_0/4$ transmission line is defined by Expression (5).

In the conventional (2n+1)-way Bagley polygon power dividers, the half-wavelength transmission line is matched just with the right-end load at only a specific frequency, whereas in the (2n+1)-way Bagley polygon power divider of the present invention the transmission lines with the respective line lengths L1, L2, . . . , Ln are matched with the right-end load at any frequency.

The foregoing matching of the power divider is independent of the lengths of the transmission lines with the respective characteristic impedances Zj (j=1, 2, . . . , n).

Figure 1:
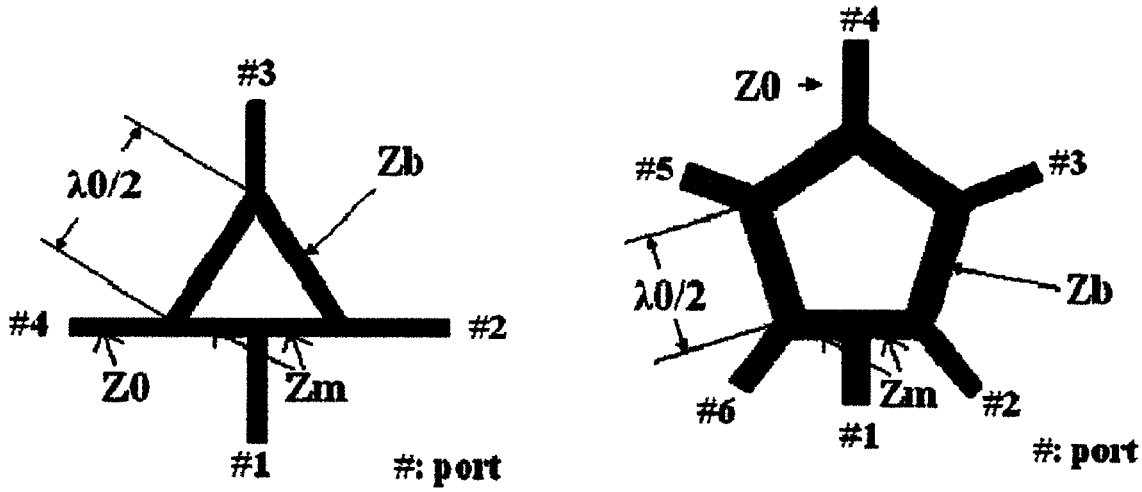
FIG. 1 shows conventional Bagley polygon three-way power divider and five-way power divider.

FIG. 1 shows examples of the conventional (2n+1)-way Bagley polygon power dividers (which will be called the Bagley polygon N-way power dividers) where N is equal to 3 or 5. In the Bagley polygon 3-way power divider #1 represents the input port and #2, 3, and 4 output ports. The output ports are located at vertices of a regular triangle with each side being the half wavelength. Similarly, in the case of the Bagley polygon 5-way power divider, the output ports are located at vertices of a regular pentagon with each side being the half wavelength. The characteristic impedance Zb of the half-wavelength transmission lines can be arbitrarily selected and is determined herein to be equal to the characteristic impedance Zm of the quarter-wavelength transmission line as in Expression (6). In Expression (6) $Z_0$ represents the load impedance at the input port and each output port.

[Mathematical Expression 6]

$$Zm = Zb = \frac{2Zo}{\sqrt{N}} \quad (6)$$

$N$: odd

Figure 4:
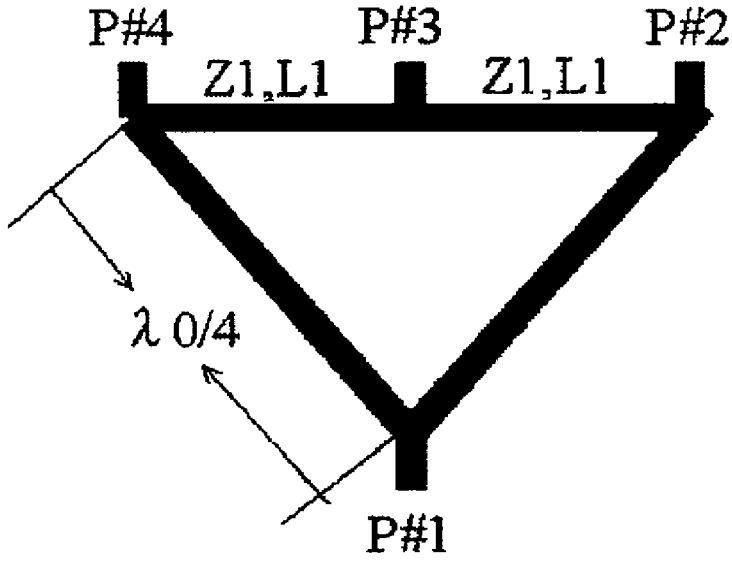
FIG. 4 is a drawing showing a pattern of a Bagley polygon three-way power divider according to the present invention.
Figure 5:
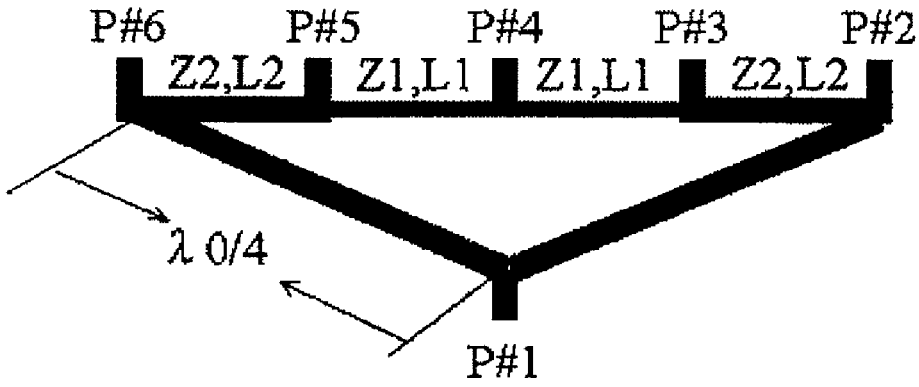
FIG. 5 is a drawing showing a pattern of a Bagley polygon five-way power divider according to the present invention.

FIG. 4 and FIG. 5 show examples of N=3 and N=5 power dividers as the Bagley polygon power dividers of the present invention. In the power dividers of the present invention, the circuit structure from input port #1 to both ends (the structure from port 1 to ports 2 and 4 in FIG. 4, or the structure from port 1 to ports 2 and 6 in FIG. 5) is the same as that of the conventional power dividers. However, distances between output ports are arbitrary. Specifically, L1 in FIG. 4 is arbitrary, and L1 and L2 in FIG. 5 are arbitrary. The characteristic impedances between output ports are given by Expression (7) in FIG. 4 or by Expression (8) in FIG. 5. In Expressions (7) and (8), $Z_0$ is also the load impedance at the input port and each output port.

[Mathematical Expression 7]

$$Z1=2Zo \quad (7)$$

Namely, in the power divider (where the number N of output ports=3) shown in FIG. 4, the characteristic impedance Z1 of the transmission lines with the length L1 connected to output port P#3 is equal to double the load impedance at output port P#3.

[Mathematical Expression 8]

$$Z1=2Zo, Z2=2Zo/3 \quad (8)$$

Namely, in the power divider (where the number N of output ports=5) shown in FIG. 5, the characteristic impedance Z1 of the transmission lines with the length L1 connected to the output port P#4 is equal to double the load impedance at output port P#4. Furthermore, the characteristic impedance Z2 of the transmission line with the length L2 connected to output port P#3 is equal to double the combined impedance of those at output ports P#3, P#4, and P#5. The same as with output port P#3 also applies to the case with output port P#5.

In general, Expression (9) holds for the proposed Bagley polygon N-way power dividers.

[Mathematical Expression 9]

$$Z1=2Zo, Z2=2Zo/3 \ldots Zk=2Zo/(N-2), k=(N-1)/2 \quad (9)$$

Figure 7:
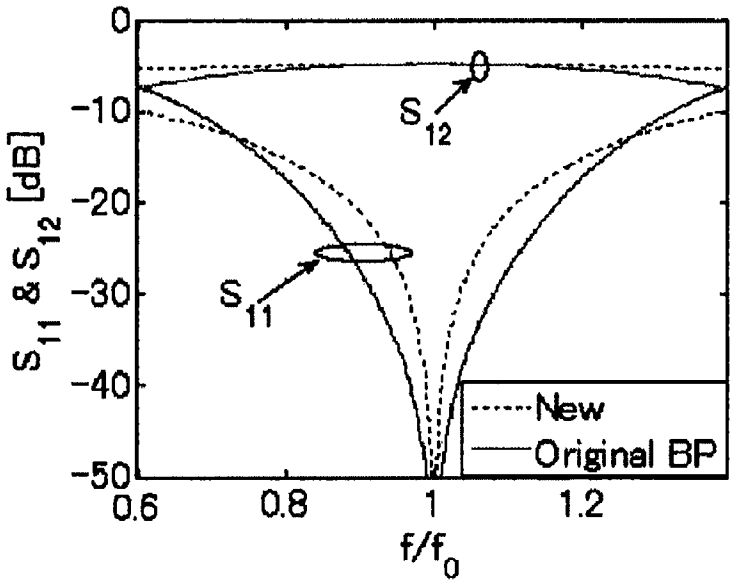
FIG. 7 shows a comparison between characteristics of conventional and newly-proposed Bagley polygon three-way power dividers.
Figure 7:
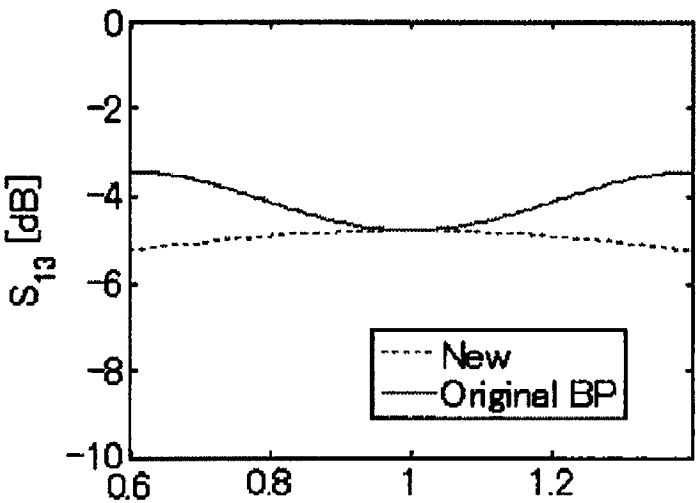
Figure 8:
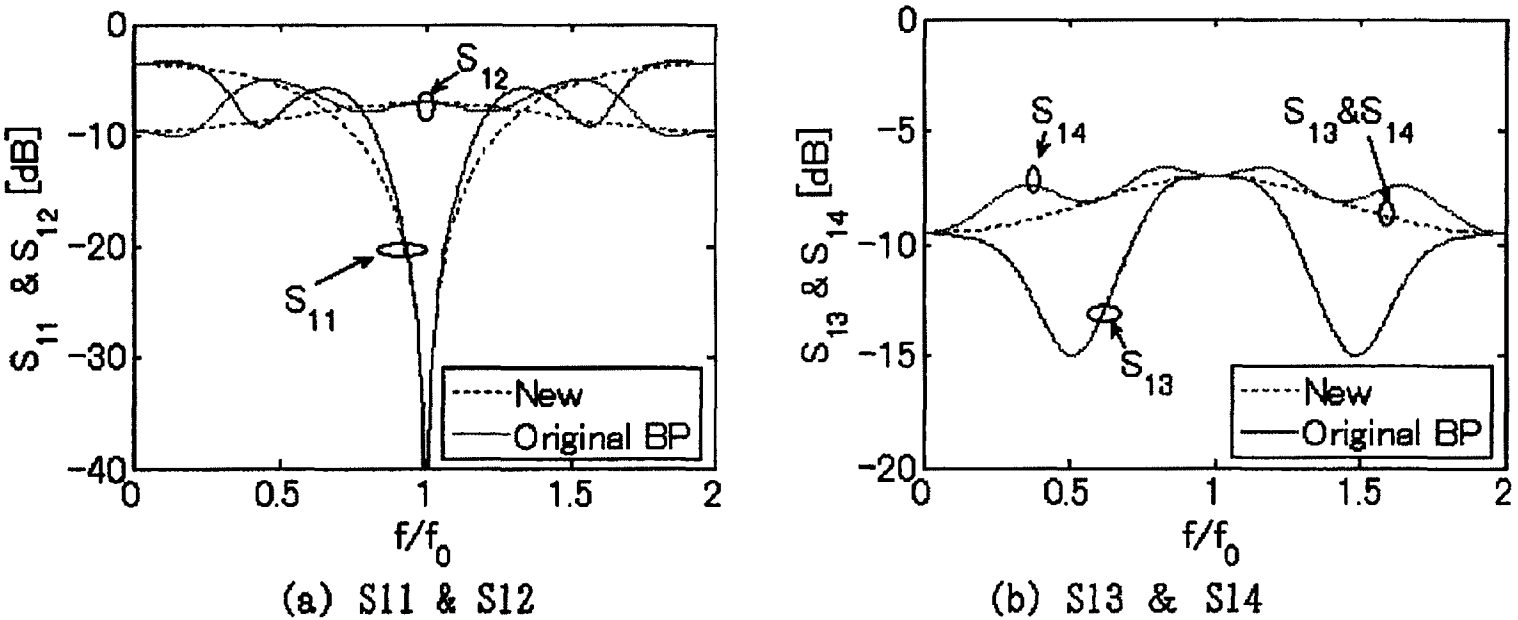
FIG. 8 shows a comparison between characteristics of conventional and newly-proposed Bagley polygon five-way power dividers.

FIG. 7 and FIG. 8 show the difference between theoretical frequency characteristics of the conventional power dividers and the power dividers of the present invention. When the 3-way power dividers are compared, reflection characteristic S11 has a narrow band in the power divider of the present invention, and dividing characteristics S12 and S13 are identical and improved. When the 5-way power dividers are compared, reflection characteristic S11 demonstrates no big difference and dividing characteristics S12, S13, and S14 all are equally improved. An improvement in a dividing characteristic means that the dividing characteristic is approximately constant regardless of frequencies. The conventional power dividers have undulating characteristics.

(Prototype Example)

Figure 6:
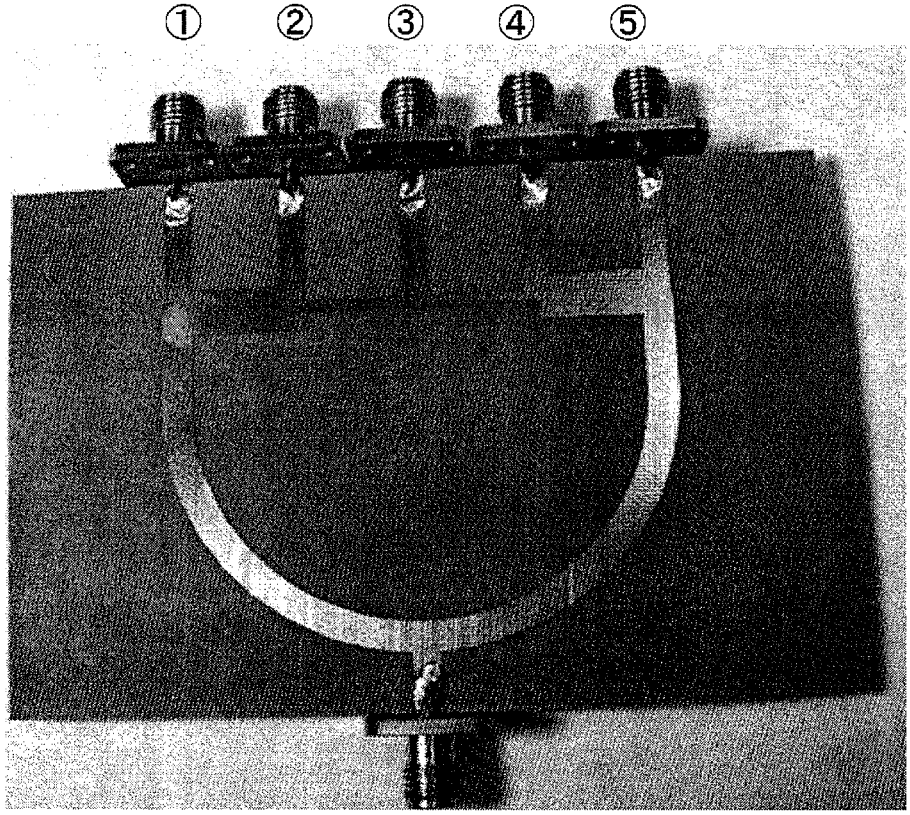
FIG. 6 is a photograph of a prototyped Bagley polygon five-way power divider according to the present invention.

Let us explain an example of a prototyped 5-way power divider according to the present invention. In FIG. 6, since the distances between the output ports are arbitrary, the distances between the output ports were designed according to the width of five SMA connectors in the drawing. The designed center frequency function is 1 GHz.

Figure 9:
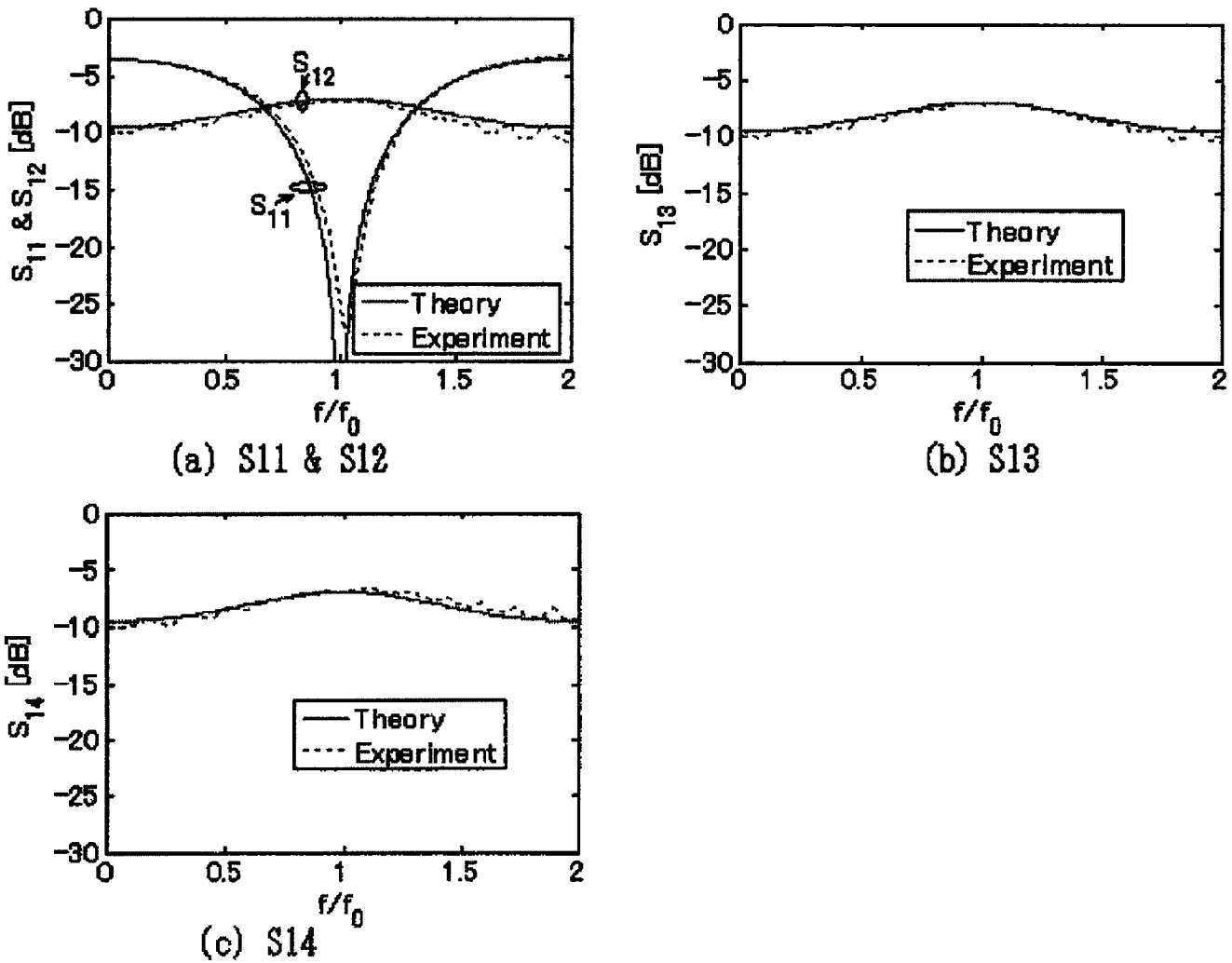
FIG. 9 shows the theory and experiment of the Bagley polygon five-way power divider according to the present invention.

FIG. 9 shows a comparison between the theory and experiment with the prototyped circuit.

When the output ports of the 5-way power divider shown in FIG. 6 are defined as output port 1, output port 2, . . . , and output port 5 from the left, the width of the transmission line connecting output ports 1 and 2 is larger than that of the transmission line connecting output ports 2 and 3. The same also applies to the relation between the width of the transmission line connecting output ports 4 and 5 and the width of the transmission line connecting output ports 3 and 4. By adjusting the widths of the transmission lines in this manner, the characteristic impedance of each transmission line can be made equal to the combined impedance of those at one or more output ports. Specifically, as the width of a transmission line decreases, the characteristic impedance of the transmission line increases. When the transmission line is a coaxial cable, the characteristic impedance of the transmission line is determined by the diameter of a core wire of the coaxial cable.

INDUSTRIAL APPLICABILITY

The present invention achieves reduction in the size of the odd-way Bagley polygon power dividers and increases degrees of freedom for design, e.g., arrangement of output ports because the distances between output ports are allowed to be freely set. In addition, since the planar configuration is realized, printed wiring is applicable and they are thus suitable for microwave-band integrated circuits.

The invention claimed is:

1. An odd-way power divider wherein only a characteristic impedance of a transmission line between output ports is designated and wherein a length of the transmission line is allowed to be arbitrarily selected; and wherein said output ports are connected in series.

2. The odd-way power divider according to claim 1, wherein a second transmission line from an input port to one of said output ports is matched at the input port and has a line length of a quarter wavelength.

3. An odd-way power divider wherein only a characteristic impedance of a transmission line between output ports is designated and wherein a length of the transmission line is allowed to be arbitrarily selected;

wherein a second transmission line from an input port to one of said output ports is matched at the input port and has a line length of a quarter wavelength; and wherein a geometry thereof is symmetrical when viewed from the input port.

4. An odd-way power divider comprising an input port and a plurality of output ports, wherein, for each of the plurality of output ports on an equivalent circuit of the odd-way power divider, a characteristic impedance of a transmission line connected to one of said plurality of output ports from a direction of the input port is equal to a combined impedance of those at one or more of said plurality of output ports at positions away from the input port with respect to the transmission line, including said one output port.

* * * * *